United States Patent [19]

McCaffrey et al.

[11] Patent Number: 4,528,107

[45] Date of Patent: Jul. 9, 1985

[54] FROTH FLOTATION

[75] Inventors: David J. A. McCaffrey; John P. Sheppard, both of Cheltenham, England

[73] Assignee: Coal Industry (Patents) Limited, London, England

[21] Appl. No.: 517,656

[22] Filed: Jul. 27, 1983

[30] Foreign Application Priority Data

Aug. 3, 1982 [GB] United Kingdom ..... 8222408

[51] Int. Cl.[3] ..... B03D 1/14

[52] U.S. Cl. ..... 252/61; 252/60; 209/166; 209/167

[58] Field of Search ..... 252/60, 61; 209/166, 209/167

[56] References Cited

U.S. PATENT DOCUMENTS 4,416,769 11/1983 McCaffrey et al. ..... 209/166

FOREIGN PATENT DOCUMENTS 207977 12/1923 United Kingdom .
953550 3/1964 United Kingdom .
1360031 7/1974 United Kingdom .
2029274 3/1983 United Kingdom .
2111866 7/1983 United Kingdom .

*Primary Examiner*—Paul Lieberman
*Assistant Examiner*—Hoa Van Le
*Attorney, Agent, or Firm*—Stevens, Davis, Miller & Mosher

[57] ABSTRACT

Minerals, especially coals for power generation, can be subjected to froth flotation using as a collector a liquid which contains at least 21% aromatics or at least 41% naphthenes. Improvements in froth yield and ash-in-tailings compared with commercial products are demonstrated.

7 Claims, 4 Drawing Figures

Figure 1:
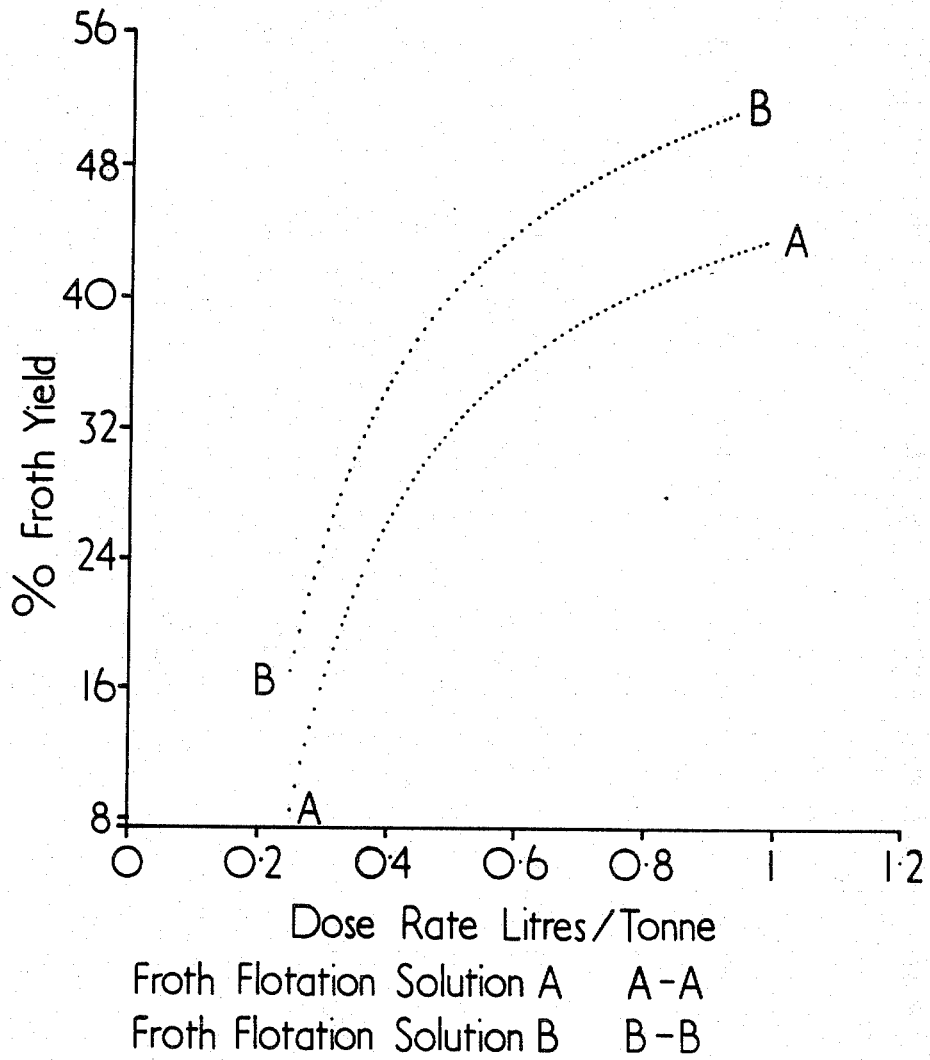

Froth Flotation Solution C C-C
Froth Flotation Solution D D-D

Froth Flotation Solution C C-C
Froth Flotation Solution D D-D

FROTH FLOTATION

This invention concerns improvements in froth flotation, especially the froth flotation of coals for power stations, general steam raising and combustion.

The techniques of froth flotation of minerals is well known in the art, and is described in the literature, for example, "Handbook of Mineral Dressing", by A. F. Taggart, John Wiley & Sons, 1954, Section 12. In the coal industry, froth floation is used to treat suspensions of coal fines which are difficult to treat in any other way. Conventional techniques involve the addition of a froth flotation oil to the suspension of the mineral and the passage of air through the suspension to create bubbles which carry the fine mineral to the surface to form a froth rick in minerals, the froth then being removed and the mineral recovered therefrom. The froth flotation oil may be a single compound or mixture of compounds of similar characteristics, but it is modern good practice, at least in the coal industry, to use a combination of a "frother" and a "collector". The "frothers" usable are of classes broadly known in the art, and the "collector" is usually a hydrocarbon oil of which distillate oils such as kerosene, industrial diesel fuel and furnace oil are the most widely used, especially kerosene. In our British Pat. No. 2,082,089B we have disclosed that certain residual oils, namely a residual oil which is predominantly parafinnic and has a cut point of at least 190° C. at atmospheric pressure, is a useful collector for froth flotation.

Our co-pending British Published Patent Specification No. 2,111,866A, is concerned with the froth flotation of coking coals in which a low ash-in-froth is the most important performance criterion together with a high froth yield. The use of an oil distillate cut in the range of 80° to 250° C. having less then 20% by wt. of naphthenes, less than 20% by wt. of aromatic content and more than 60% by wt. total content of n-alkanes and branched alkanes is disclosed.

In the production of coals for power stations, for general steam raising and industrial coals for combustion, the most important criteria in froth flotation are considered to be a high froth yield, together with a high ash-in-tailings. The froth yield is the weight percentage of solids in the dried froth against the solids content of the initial charge of coal slurry, and the ash-in-tailings is the weight percentage of ash (mineral matter remaining after combustions) in the solids residue from the froth flotation cell, on a dry basis. Since the recovered fine coal from the flotation cells is going to combustion, clearly high yield are important as well as minimising the ash content by maximising the ash rejected from the cells (ash in tailings).

The present invention therefore provides the use of a liquid having an aromatic content greater than 21% or a naphthenic content greater than 41%, by weight, as a collector in the froth flotation of minerals. The invention also provides a froth flotation mixture comprising the defined liquid in association with a "frother".

The invention further provides a method of treating minerals in a froth flotation cell comprising the operation of the cell using a collector which is the defined liquid.

Preferably, the liquid has a total content of aromatics and naphthenes greater than 62% by wt; the aromatic content is preferably in the range 21 to 31% by wt. The remainder of the liquid is suitably made up of alkanes, e.g., a mixture of n- and branched-alkanes, but may be any organic material which does not interfere with the effectiveness of the collector in use. The alkane content of the preferred liquid is less than 56%, more preferably less than 38%. Liquids suitable for use in the invention may be obtained from a wide variety of sources provided that the component requirements are met. For example, the liquid may be a distillate boiling in the range 80° to 350° C., preferably 150° to 250° C., a residue such as the residue from the distillation of gas condensate, or from a second distillation of crude oil, an oil produced by the vacuum distillation of crude oil or a neutral hydrocarbon fraction produced from coal tar, and combinations of these materials or blends thereof with other hydrocarbon materials to give the required component content. One such collector is the condensate resulting from the distillation of North Sea gas condensate blended with an aromatic solvent.

The collector of the invention is used in conventional manner with a "frother". A preferred "frother" is a polyglycol ether, and these are commercially available; other conventional "frothers" may, however, be used. The "frother" is suitably used with the collector in an amount of up to 40% by weight, suitably 10 to 20% by weight, especially about 15% by weight. The collector and frother may be combined before use and supplied to the froth flotation cell as a mixture, but they may be fed separately to the cell if desired.

The invention offers particular advantages over other collectors in the treatment of coals for power stations, but the invention may be used also in the treatment of other coals or other minerals which require an oily collector, such as talc or illmonite. The particular benefits in relation to power station coals will be illustrated in the following Examples of the invention.

EXAMPLE 1

Froth flotation solution A. A commercially available froth flotation solution recommended for use for steam coal treatment, containing about 15% by weight of a standard commercial polyglycol ether "frother" together with a hydrocarbon liquid collector. The hydrocarbon liquid was analysed to contain 26.5% by weight naphthanes, 20% aromatics and 53.5% n- and branched-chain alkanes. The aromatic content of this collector is less than 21% and the naphthenes content is less than 41% so that the hydrocarbon liquid does not fall within the present invention but gives a good comparison.

Froth flotation solution B. A solution was made up containing 15% of the same "frother" as in solution A, together with 68% of a residual oil obtained by distilling off components boiling up to 190° C. from a North Sea natural gas condensate and 17% of a completely aromatic solvent. The residual oil and the solvent, together forming a liquid collector according to the invention were analysed to give a total naphthene content of 21%, a total aromatic content of 23.5% and the remainder being n- and branched-chain alkanes. The aromatic solvent was a commercial aromatic solvent boiling over the range 170° to 250° C. and containing alkyl benzenes, mainly tri-methyl benzenes and ethyl methyl benzenes.

The froth flotation solutions A and B were tested in a laboratory froth flotation cell with coal feed from the National Coal Board's Bilthorpe Colliery coal preparation plant. The coal from the plant is sold to power stations. Tests were carried out at a number of dose rates ranging from 0.25 to 1 liter of solution per tonne of coal (on a dry basis), which is charged to the cell in the form of a slurry containing nominally 10% solids.

A study was made of the froth yield, that is the percentage of dried froth against solids content of the initial charge of coal slurry, against dosage rate of the froth flotation solution. The results were plotted on the graph of FIG. 1 and a curve drawn by computer. It can be seen that froth yields for solution B, according to the invention, were about 8 percentage points greater than for the conventional commercial solution, over the whole range tested.

Figure 2:
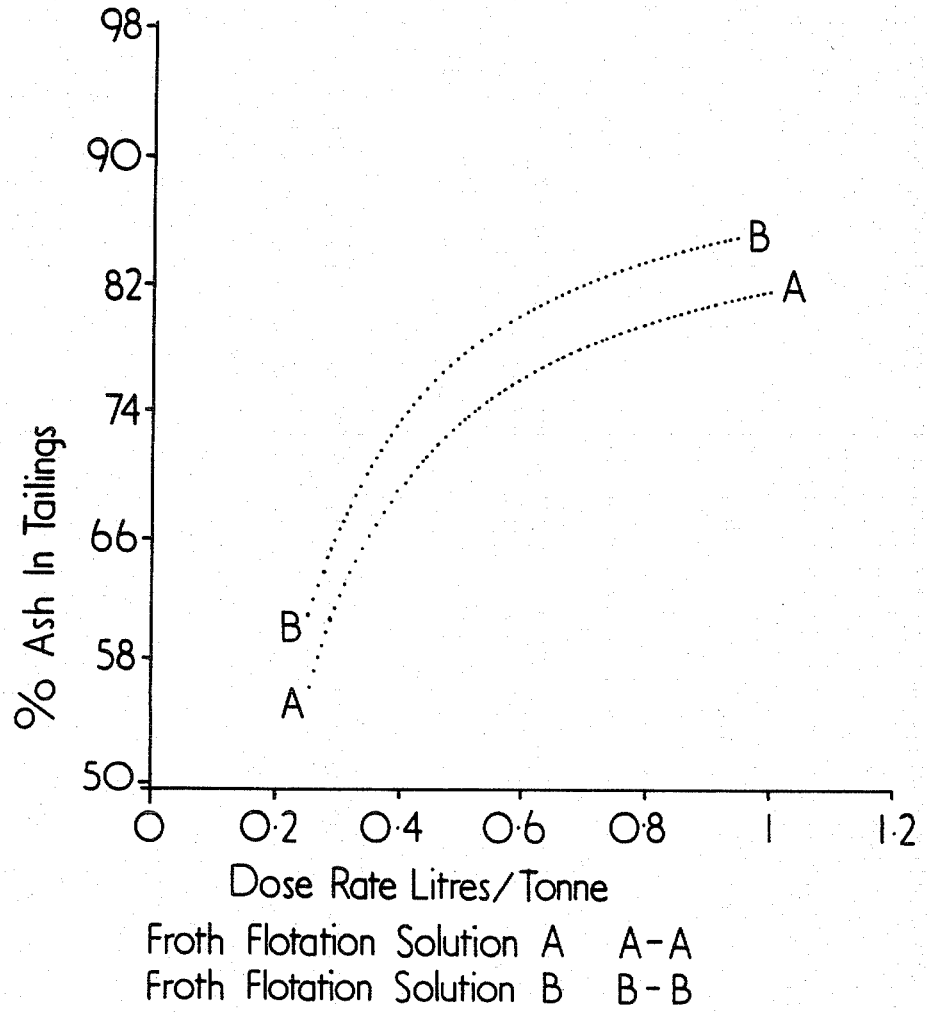

The ash-in-tailings, that is the percentage ash in the solids residue from the froth flotation cell, was also plotted against dosage rate and curves drawn by computer and is shown in FIG. 2. Over the range tested, the solution B gave an average 4 to 5 percentage points improvement over the conventional commercial solution.

EXAMPLE 2

Froth flotation solution C. A commercially available froth flotation solution recommended for use for steam coal treatment, containing about 20% by weight of a standard commercial polyglycol ether "frother" together with a hydrocarbon liquid collector. The hydrocarbon liquid was analysed to contain 40.1% by weight naphthenes, 13.1% aromatics and 46.8% n- and branched-chain alkanes. The aromatic content of this collector is less than 21% and the naphthenes content is less than 41% so that the hydrocarbon liquid does not fall within the present invention but gives a good comparison.

Froth flotation solution D. A solution was made up containing 20% of the same "frother" as in solution C, together with 60% of a conventional Gas Oil and 20% of a completely aromatic solvent. The Gas Oil and the solvent, together forming a liquid collector according to the invention were analysed to give a total naphthene content of 24.5%, a total aromatic content of 33.25% and the remainder being n- and branched-chain alkanes. The aromatic solvent was a commercial aromatic solvent boiling over the range 170° to 250° C. and containing alkyl benzenes, mainly tri- and tetra-methyl benzenes and ethyl methyl benzenes.

The froth flotation solutions C and D were tested in a laboratory froth flotation cell with coal feed from the National Coal Board's Dodworth Colliery coal preparation plant. The coal from this plant is sold to power stations. Tests were carried out at a number of dose rates ranging from 0.25 to 1 liter of solution per tonne of coal (on a dry basis), which is charged to the cell in the form of a slurry containing nominally 10% solids.

Figure 3:
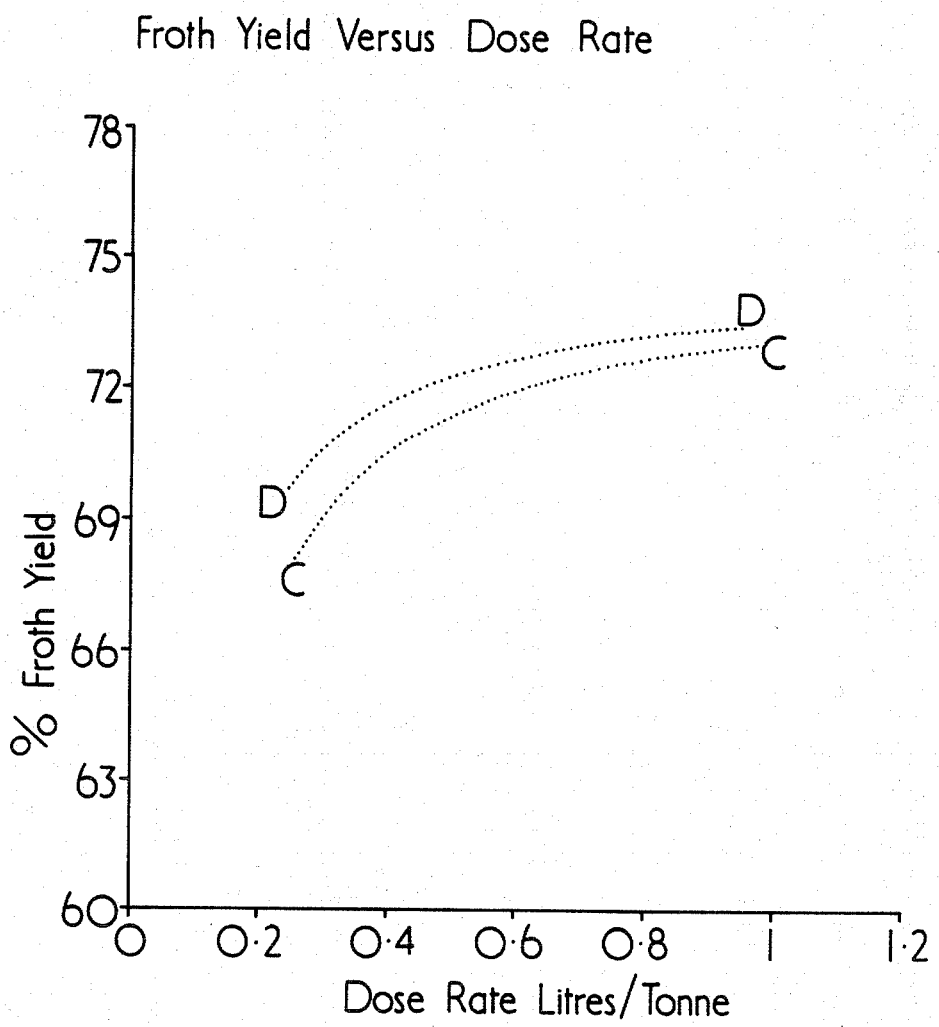

A study was made of the froth yield, that is the percentage of dried froth against solids content of the initial charge of coal slurry, against dosage rate of the froth flotation solution. The results were plotted on the graph of FIG. 3 and a curve drawn by computer. It can be seen that froth yields for solution D, according to the invention, were about 1.8 to 0.5 percentage points greater than for the conventional commercial solution, over the whole range tested.

Figure 4:
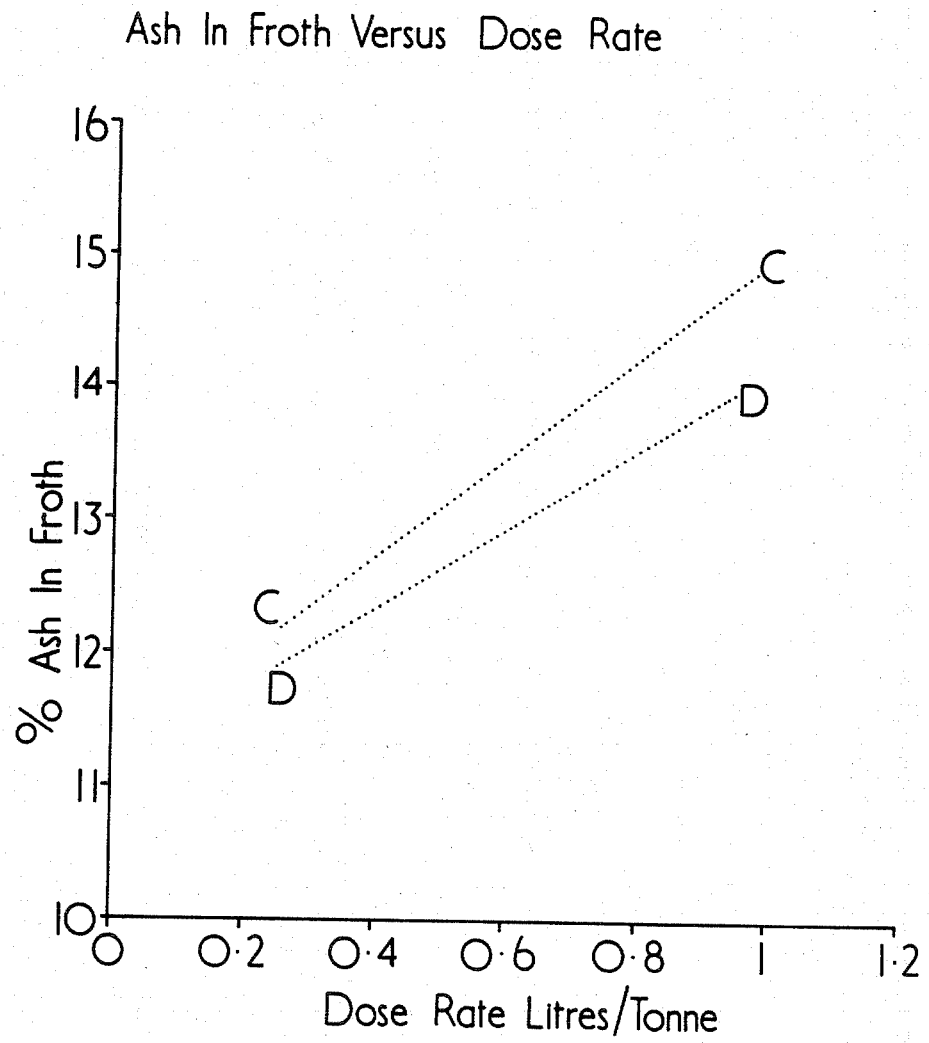

This solution has the added advantage that the ash-in-froth, that is the percentage ash in the froth floated solids from the cell, was also plotted against dosage rates and lines drawn by computer shown in FIG. 4. Over the range tested, the solution D gave an average 0.27 to 0.85 percentage points improvement over the conventional commercial solution. This is an unexpected advantage, as normally one observes a higher ash-in-froth with a higher yield.

It can be seen that the present invention provides economically significant improvements in the froth flotation treatment of power station coals compared to a good commercial froth flotation solution.

We claim:

1. A method of treating minerals by froth flotation comprising the operation of a froth flotation cell using a "collector" consisting essentially of a hydrocarbon liquid having an aromatic content greater than 21% or a naphthenic content greater than 41% by weight.

2. A method as claimed in claim 1, wherein the mineral is coal.

3. A method as claimed in claim 2, wherein the coal is a steam coal.

4. A method as claimed in claim 1, wherein the liquid has a total content of aromatics and naphthenes greater than 62% by weight.

5. A method as claimed in claim 4, wherein the content of aromatics is in the range 21 to 31% by weight.

6. A method as claimed in claim 1, wherein the hydrocarbon liquid contains not more than 56%, by weight, of alkanes.

7. A method as claimed in claim 6, wherein the content of alkanes is less than 38% by weight.

* * * * *